United States Patent [19]

Dassler

[11] Patent Number: 4,523,396

[45] Date of Patent: Jun. 18, 1985

[54] ATHLETIC SHOE HAVING SPIKE OR STUD-SHAPED CLEATS EXCHANGEABLY ARRANGED AT THE RUNNING SOLE

[75] Inventor: Armin A. Dassler, Herzogenaurach, Fed. Rep. of Germany

[73] Assignee: Puma-Sportschuhfabriken Rudolf Dassler KG, Fed. Rep. of Germany

[21] Appl. No.: 523,790

[22] Filed: Aug. 16, 1983

[30] Foreign Application Priority Data

Sep. 2, 1982 [DE] Fed. Rep. of Germany ..... 3232604

[51] Int. Cl.[3] ..... A43B 5/00; A43C 15/00

[52] U.S. Cl. ..... 36/134; 36/62; 36/67 D

[58] Field of Search ..... 36/61, 62, 67 D, 67 R, 36/134, 67 B, 7.7, 7.8, 124, 67 C, 59 B, 65, 101

[56] References Cited

U.S. PATENT DOCUMENTS

| | | | |
|---|---|---|---|
| 2,182,737 | 12/1939 | Petruzates | 36/61 |
| 2,607,133 | 8/1952 | Marlowe | 36/101 |
| 3,354,561 | 11/1967 | Cameron | 36/128 |
| 3,812,605 | 5/1974 | Kaestle | 36/67 D |
| 4,430,810 | 2/1984 | Bente | 36/121 |

FOREIGN PATENT DOCUMENTS

| | | | |
|---|---|---|---|
| 804072 | 4/1951 | Fed. Rep. of Germany | 36/128 |
| 1426358 | 12/1965 | France | 36/134 |

*Primary Examiner*—Werner H. Schroeder
*Assistant Examiner*—Steven N. Meyers
*Attorney, Agent, or Firm*—Sixbey, Friedman & Leedom

[57] ABSTRACT

A running sole for athletic shoes, wherein exchangeably arranged cleats of a row of cleats are fastened by a common holding means which differs from known holding means of this type in that it is lighter in weight and simpler to handle. The cleats have base parts which are inserted into openings in the running sole and are fastened by spring or form-fitting means, so that they cannot twist about their longitudinal axis. The base parts have at least one borehole in alignment with lateral boreholes in the running sole in each row of cleats, so that, by means of the insertion of a single tube- or rod-shaped shaft into the lateral boreholes, all of the cleats of a respective row are fastened to the sole.

17 Claims, 15 Drawing Figures

ATHLETIC SHOE HAVING SPIKE OR STUD-SHAPED CLEATS EXCHANGEABLY ARRANGED AT THE RUNNING SOLE

BACKGROUND AND SUMMARY OF THE INVENTION

This invention relates to an athletic shoe having spike- or stud-shaped cleats exchangeably arranged in rows of openings in the running sole, each row of cleats being fastened to the sole by a single holding means.

In the case of the known athletic shoes of this type, threaded inserts made of aluminum, steel or a similar material are cast or pressed into the running sole made of a plastic material, such as polyamide or polyurethane. The spike- or stud-shaped cleats, such as spikes, claws, studs or similar means, are screwed directly into these threaded inserts. In order to ensure a somewhat tight fit of the cleats, they must be tightened to the limit, if possible, by means of a tool made especially for that purpose. The result is that the thread of the inserts is often unintentionally strained to the extent that it becomes useless after only a few exchanges. The latter is especially true when, for reasons of weight reduction, instead of the steel inserts, inserts are used that are made of a lighter material, such as aluminum. These and other disadvantages occur also when, in order to make the cleats exchangeable, snap fasteners of the press-stud type are used instead of threaded inserts. This type of fastening has the additional disadvantage that a twisting of the inserted profiles is hard to avoid, especially in the case of excessive strain.

It has been tried to eliminate the disadvantage of the above-mentioned form of mountings for the cleats by fastening the cleats on separate strips having trapezoidal cross sections arranged transversely to the longitudinal axis of the sole. These strips are pushed into correspondingly shaped dovetailed grooves of the running sole (compare DE-OS No. 25 35 623). Here, the strip, on the one hand, adjoins the standing edge of the running sole and is, on the other hand, fastened by means of a plastic mounting stud screwed only into the strip, with said plastic mounting stud, with its part that projects over the strip, reaching into a recess in the shape of a borehole disposed in the bottom of the groove. This construction has the disadvantage that the small plastic screws are stressed with respect to shearing when the profiled parts and, thus, the strips are affected by forces in the direction of the sliding-in side. This type of fastening, therefore, does not ensure a rapid exchange or replacement of the strips with the pertaining cleats, especially when the stress has caused the small plastic screw to break off. Such constructions are, therefore, rarely used in practice.

On the basis of DE-AS No. 13 00 842, it is also known to fix several cleats, arranged next to one another in a row, by means of a joint retaining plate with keyhole-shaped openings which is inserted into a laterial opening of the running sole, so that the keyhole-shaped openings of the retaining plate are made to coincide with open recesses in the running sole. The cleats are inserted into the openings of the running sole so that they reach through the keyhole-shaped openings in the retaining plate. The round heads of the cleats have slot-shaped notches. After a relative shift between the retaining plate and the cleats in the long, approximately rectangular opening part of the keyhole-shaped openings, the heads of the cleats having the notches support themselves on the retaining plate. It is the disadvantage of this construction that the retaining plate is the sole securing means of the cleats with respect to all types of stress. Because of the deep, groove-shaped notches in the heads of the cleats, the cleats are particularly endangered with respect to breakage through shearing forces. In addition, the retaining plate must be constructed so as to be relatively sturdy because it is the sole holding element for the cleats. This results in a considerable increase in weight which, in most cases, is not acceptable.

The invention is, therefore, based on the objective of providing a holding means for the exchangeably arranged cleats of the running sole of an athletic shoe that, in comparison to the known holding means, is lighter, simpler to handle, as well as more reliable and more durable, and that makes it possible for the athlete to himself/herself provide his/her athletic shoes very rapidly with cleats that are optimally adapted to the respective sport and soil condition.

According to preferred embodiments of the invention, this objective, in the case of an athletic shoe of the initially-mentioned type, is achieved by means of the fact that the base parts of the cleats are fastened in the openings of the running sole in a manner so that they cannot be twisted about their longitudinal axis, and wherein base parts of the cleats have at least one borehole that is alignable with lateral boreholes in the running sole in each row of cleats to form a continuous borehole, a shaft being provided as a fastening means for each of said row of cleats, so that, by means of the insertion of a single said shaft into said continuous borehole, all of the cleats of a respective row of cleats is fastened jointly to said holding means.

The athletic shoe according to the invention has the advantage, over the known athletic shoes, that the base parts of the cleats, irrespective of their cross section, are inserted into openings of the running sole, so that they are always firm with respect to twisting and cannot be lost. A shaft penetrates the running sole transversely and represents an additional holding element that is not stressed with respect to shearing and may, therefore, be formed so as to be comparatively thin and, thus, light. Because of the small dimensions of the transversely-extending shaft, a weakening of the actual running sole can also be avoided, because this shaft can always be housed only in an additional strip-shaped holding means of the running sole. Because of the low stress produced, a hollow shaft may even be used, so that the added weight is practically without significance.

It is especially advantageous to provide the base parts, arranged at the edge of the running sole along their shaft, with several fastening points. Thus, varying lengths of grip may be obtained with one and the same base part, which is an advantage inventory-wise, because the same cleat can be used for varying purposes.

Another advantage is that the bolt-shaped holding parts, at the fastening points of the running sole, may be formed to have the shape of a half shell and may be provided with a wedge-shaped recess, as well as with joints, that have the same shape on both sides, which are used for receiving the base part. In this manner, the base part is mounted in the wedge-shaped recess, so that it can be swivelled in the direction of the longitudinal axis of the sole. Consequently, the cleats, even in the case of a very bent running sole, can be removed from the track or from the playing field always in a vertical or at least largely in a vertical direction, which not only saves strength, but also especially avoids, to a great extent, damage to the cleat or the playing field.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
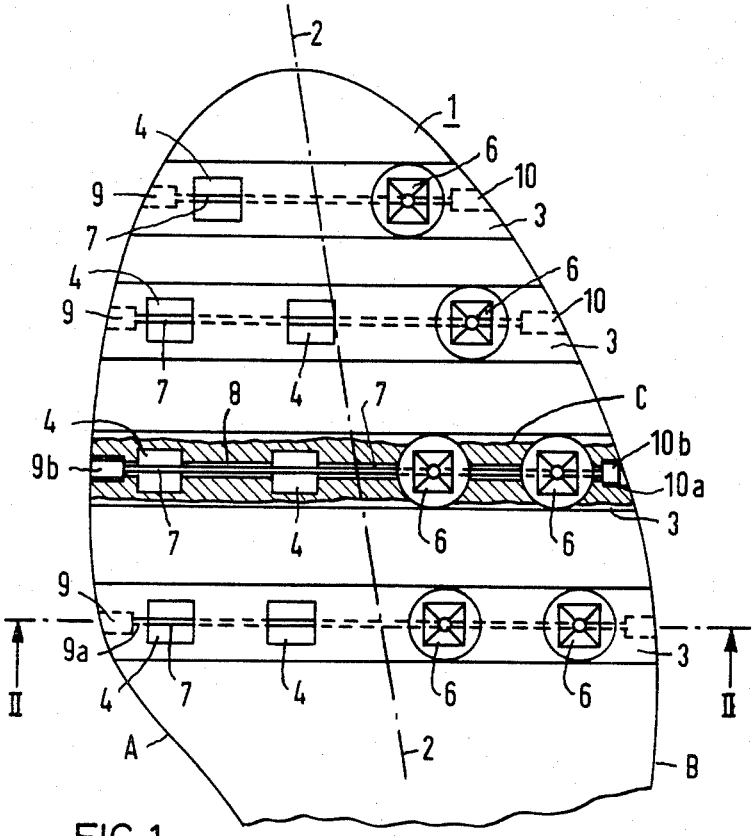
FIG. 1 shows a plan view of the tread of the sole of an athletic shoe according to the invention.

With reference to FIG. 1, the running sole of an athletic shoe according to the invention has the number 1, and bolt- or strip-shaped holding means, extending transversely to the longitudinal axis 2 of the sole, preferably in the form of sole reinforcements that are integrated with the running sole 1, have the number 3. The holding means 3 have openings 4 which extend in rows at a distance from one another, and either penetrate the whole running sole 1 or penetrate into the running sole 1 only far enough as to still leave a relatively thin wall at the inside surface of the sole and, therefore, form blind holes, as they are, for example, shown in FIG. 2.

Base parts 5 of spike- or stud-shaped cleats 6, having the same shape and size as the openings 4, are inserted into said openings 4, i.e., the base parts 5 are inserted into the openings 4, preferably by means of a sliding or pressing fit. All types of spikes, claws or studs may be used as cleats 6, such as they are conceivable and are used in the case of athletic shoes.

As shown in FIG. 1, the shape of the cross section of the base parts 5 of the cleats 6 may be polygonal, for example, square or rectangular; however, circular cross sections or cross sections having the shape of a segment of a circle may also be used for the base parts 5. In the case of polygonal shapes of the cross section of the base parts, the fit between the inside wall of the openings 4 and the circumference of the base parts 5 does not have to be too close because the twisting forces exercised on the cleats are distributed evenly and over a large area at the wall sections of the openings 4, and can, therefore, be well tolerated. However, in the case of a circular cross section of the base parts 5, it is advantageous to dimension the fit to be somewhat closer, so that the twisting forces are not absorbed exclusively by their fastening means 7. The fastening means 7 are in the form of a tube- or rod-shaped shaft and penetrate the cleat bases 5. Enabling the bases of the cleats to limit the load transmitted to the fastening means has the considerable advantage that the shaft 7 may be dimensioned to be correspondingly thinner, so that a considerable amount of weight can be saved in comparison to known strip-shaped retaining plates. The cross section of the shaft 7 may be arbitrarily selected of any form. In addition to round shafts, those with an angular cross section may also be used.

Figure 2:
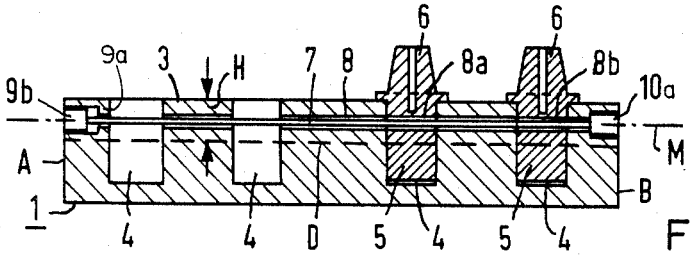
FIG. 2 shows a cross section along the line II—II in FIG. 1.

The shaft 7 is inserted into a hole 8 in the side of the sole, at either edge A or B. The hole 8 extends through the running sole 1 as a continuous borehole in the bolt- or strip-shaped holding means 3. The base parts 5 of the cleats 6 have corresponding boreholes 8*a*, 8*b*, (FIG. 2), which are aligned with the borehole 8 in the running sole 1, or in the holding means 3, so that all of the cleats 6 of a row of cleats may be fastened jointly on a common shaft 7. As shown in FIG. 2, the holding means has a height H (delineated by broken line D) that is larger than the diameter of boreholes 8, and a center line through the boreholes lies in the center plane M of the holding means 3.

For the mounting of the shaft 7 in place, the boreholes 8, in the area of the edge A of the sole 1, have a head-shaped enlargement 9, which creates a collar 9*a* which surrounds and supports the shaft 7 adjacent thereto, and into which a head-shaped enlargement 9*b*, at the end of the shaft 7, is received. Reference is made in this respect to the broken-away part C of the running sole 1 in FIG. 1, wherein shaft 7 is exposed, as well as to the cross-sectional view of FIG. 2.

In the area of the other edge B of the sole 1, the boreholes 8 may have a head-shaped enlargement 10, into which the threaded nuts 10*b* can be inserted and screwed onto a corresponding threading on the shaft ends 10*a*. Thus, a fixing of all of the cleats 6 is obtained in a manner that can be released simply within any row of cleats, enabling a rapid replacement or exchange of any cleats of a row of cleats.

Figure 3:
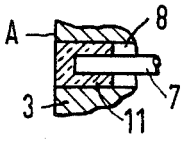
FIG. 3, at a very enlarged scale, shows one mounting point or the lock of an opening on the side of the edge for a tube- or rod-shaped shaft serving as a fastening means.
Figure 4:
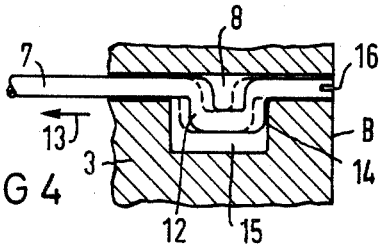
FIG. 4, also at a very enlarged scale, shows another mounting point for the shaft which, at the same time, has a lock formed in the manner of a quarter-turn fastener.

Another type of a releasable fastening of the shaft 7 in the borehole 8, in the manner of a quick-locking means, is shown in FIGS. 3 and 4, where FIG. 3 shows the edge A of the sole and FIG. 4 shows the edge B of the sole.

The quick-locking means shown there is formed as a bayonet lock. In this case, the end of the shaft 7 is, for example, on the A side of the edge of the sole, pressed against a plug 11, inserted or case in there, and consisting of a rubber-elastic material. The other side of the shaft 7 on the B side of the edge of the sole may (as shown in FIG. 4 at an enlarged scale) be provided with a key-bit shaped bend 12 which is inserted in a horizontal orientation, to an extent that it acts against the elastic force of the plug 11, in the direction of the arrow 13, is then slightly turned around the longitudinal axis of the shaft 7 (where it assumes the broken line position in FIG. 4), and is then immediately released again, in which case, the bend 12 is biased by the resiliency of plug 11 against the somewhat recessed wall 14 of a pocket-shaped enlargement 15 (solid line position of FIG. 4), so that the base parts 5 are held without screws and cannot be lost.

Instead of the rubber-elastic stopper 11, a spring, such as a small flat spring, may be inserted or cast into the opening 9 so as to have the same effect.

In order to be able to rotate the shaft, it is advantageous to provide said shaft 7, on the freely accessible side of the edge B of the sole 1, with a slot 16 into which a tool may be inserted.

Figure 5:
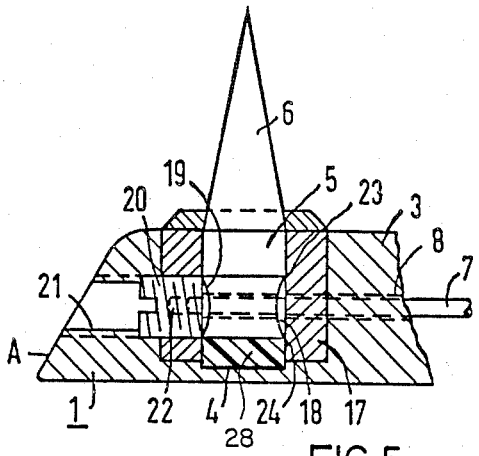
FIG. 5 shows a cross section through a part of the edge of the running sole, at a very enlarged scale, with a spike which has only one single fastening point on its base part.

FIG. 5 shows an embodiment of the invention where the base part 5 of the cleat 6 is not held, in the opening 4, directly by means of a snug fit, but is fastened in the opening 4 in an inserted piece 17. In addition, a form-fit fastening of the base part 5 within the inserted piece 17 is provided. For this purpose, the base part 5 is provided with a surrounding or at least partially surrounding groove 18, into which, in a form-fitting manner, the correspondingly dome-shaped end 19 of a screw 20 engages, with said screw 20 being inserted into the screw thread 21 on the side of the edge A of the sole 1. For an additional guiding and mounting of the shaft 7, the screw 20 is preferably provided with a wavy borehole 22 into which one end of shaft 7 is inserted. The edges 23, 24 of the groove 18 also enhance the form-fitting holding of the cleat 6 by providing an additional friction fit on the inside wall of the inserted piece 17. This type of fastening of the cleats 6 is especially suitable when the athletic shoes having these cleats 6 are used on very hard to icy soil or bases.

Figure 6:
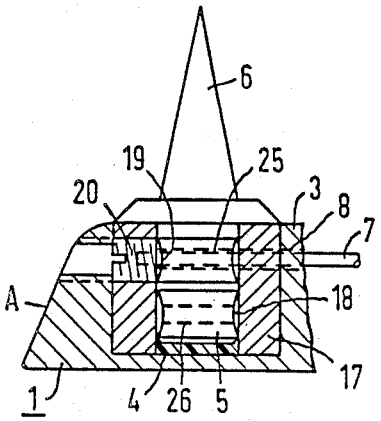
FIG. 6 shows a similar cross section through a part of the edge of the running sole with a spike which, on its base part, has two fastening points, an upper fastening point being shown in use and a lower fastening point shown held in readiness.
Figure 7:
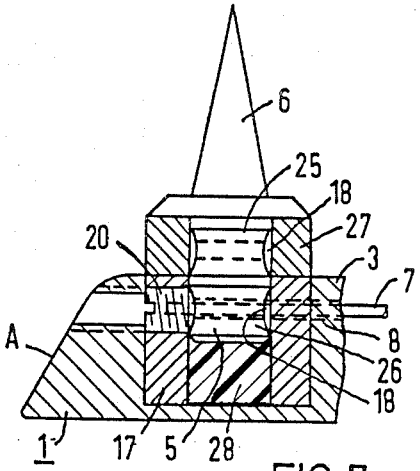
FIG. 7 shows an arrangement where, in the case of a run-down profile point, the original height of the profile is restored or a larger height of the profile is obtained, either by using the lower fastening point or by inserting a filler piece.

In order to be able to use less cleats for one or several rows, or in order to balance the wear of the cleats, it is advantageous to provide the base parts 5 used in the areas near the edges A, B with several fastening points, as shown in FIGS. 6 and 7. In FIG. 6, the upper fastening point 25 is shown in the operative position, while the fastening point 26 is in readiness. FIG. 7 shows the lower fastening point 26 in the operative position. The other parts of this arrangement have the same reference numbers as in FIG. 5.

In order to fill out the corresponding gaps between the bottom of the bases 5 and openings 4, intermediary pieces 27 and 28, made, for example, of a light metal or a plastic material, may be inserted.

Figure 8:
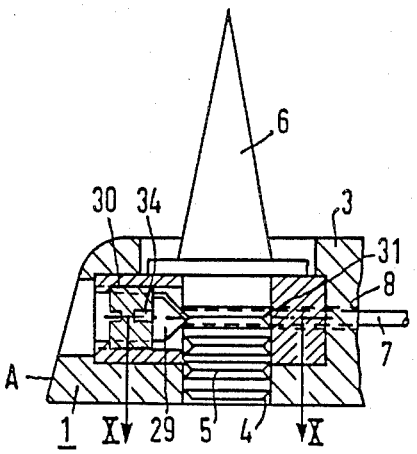
FIG. 8 shows another embodiment for obtaining a variable height of the profile, where a square base part is equipped with several notches surrounding it either partially or completely, with a wedge-shaped part, pressed in by a set screw, engaging in said notches in order to fix the respective height.
Figure 9:
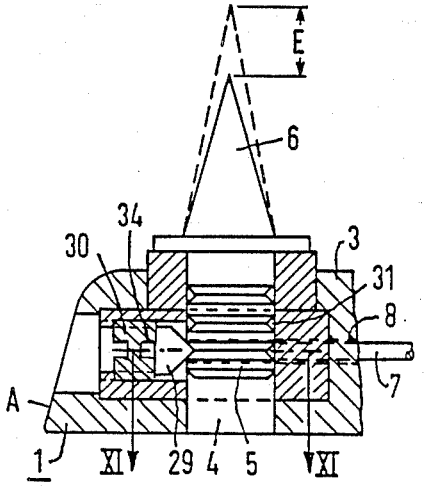
FIG. 9 shows an arrangement that is comparable to that of FIG. 8, but where the cleat has a cylindrical base part and the height of the profile can be changed by means of a correspondingly formed wedge-shaped part.

The constructions according to FIGS. 8 and 9 show other examples of how the difference in height resulting from the wear of the profiles can be balanced in a more closely stepped manner, or how cleats of various heights can be made available in the areas near the edges A, B of the sole.

For this purpose, FIG. 8 shows a cleat with a base part 5 having a square cross section, and FIG. 9 a cleat with a circular cross section. In addition, FIG. 8 shows a base part with a new cleat 6, while the cleat 6 in FIG. 9 has already been worn down (from the broken line size, corresponding to that of FIG. 8) by the distance E and has been newly adjusted and fastened in a position raised by a distance corresponding to the difference of height E.

Figure 10:
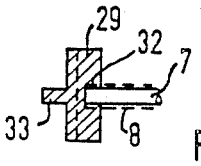
FIG. 10 shows a cross section of the wedge-shaped part as it would appear in a plan view taken along the line X—X of FIG. 8.
Figure 11:
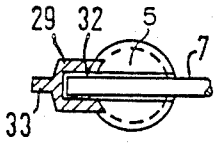
FIG. 11 shows a cross section of the wedge-shaped part as it would appear in a plan view taken along the line XI—XI of FIG. 9.

In both cases, the fastening of the base parts 5 takes place by means of a wedge-shaped part 29 which, in each case, is pressed by a screw 30 into a groove 21 that reaches completely or partially around the base part 5 of the cleat 6. In addition, the shaft 7 may be pushed into the concerned base parts 5 and may be mounted in recesses 32 of the wedge-shaped parts 29 (FIGS. 10 and 11). Furthermore, the wedge-shaped parts 29 have pegs 33 that are inserted into a borehole 34 of the set screw 30 and are, therefore, guided thereby.

Figure 12:
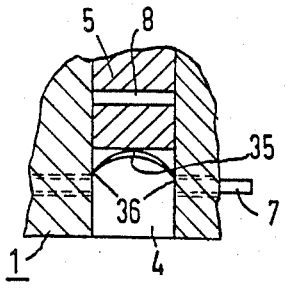
FIG. 12 shows the lower end of a base part of a spike or stud having a spreading element in an opening of the sole, at a location where the base part of the spike or the stud has not yet reached its operative position.
Figure 13:
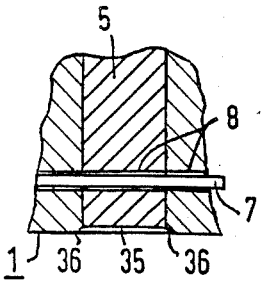
FIG. 13 shows the base part fully inserted into its operative position, with a fastening shaft inserted therethrough and with the spreading element in its operative position.

FIG. 12 shows an opening 4 in the running sole 1, into which the base part 5 of a cleat 6, with the borehole 8 for the shaft 7, is not yet completely inserted, i.e., has not yet been brought into the operative position. A spreading element 35 is arranged at the bottom side of the base part 5 which may, for example, be a plate spring in the shape of a crescent having claw-shaped extensions at the sides ending in a point. As soon as the base part 5 is brought into its operative position, and the shaft 7 has been pushed further through the borehole 8, as shown in FIG. 13, the claw-type extensions 36 will be pressed into the adjacent material and held in a stretched position.

Figure 14:
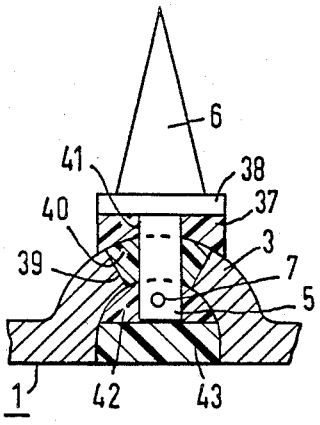
FIG. 14 shows a holding member formed as a half shell with outside and inside parts of the same shape which are flexibly assembled.
Figure 15:
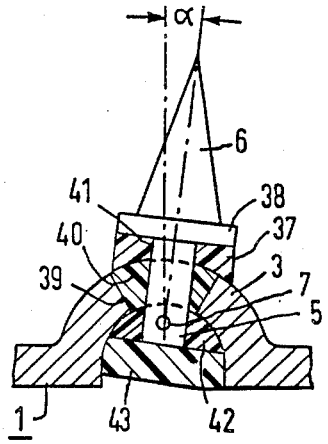
FIG. 15 shows the embodiment of FIG. 14, where a sloping position of the cleat is represented.

In the case of the arrangements shown in FIGS. 14 and 15, the bolt- or strip-shaped holding means 3, disposed transversely to the longitudinal axis 2 of the sole, have approximately the shape of half shells. The cleat 6 has a supporting part 37 which, on the one hand, rests fully on the collar 38 of the cleat and, on the other hand, on the opposite side, has the shape of a segment of a circle having the same curvature as the outer part of the half shell of the holding means 3. At this location, the holding means 3 has a wedge-shaped recess 39 filled with an elastic compressible material 40. Especially suitable for use as such a material is a foamed plastic, such as foamed polyurethane or foamed silicones. A recess 41, through which the base part 5 extends, is provided in the compressible material 40. At the concave (inner) side of the holding means 3, a joint 42, having the shape of a segment of a cylinder and having the borehole for the shaft 7, is inserted, and an end piece 43 of uniform thickness is placed behind said joint 42. In this manner, the profile of the cleat 6 is perpendicular to the surface plane of the sole. This embodiment permits the cleat 6 to be placed diagonally at a certain angle $\alpha$, as shown in FIG. 15. The result is that it is possible to disengage the cleats from the track or the playing field in a direction normal or almost normal thereto, which saves strength and improves performance, as well as serving to protect the track or the playing field, because the flexible mounting of the cleats 6 makes it possible to avoid damage, such as cracks or rips of the corresponding ground or ground covering material.

When the above-described cleats are inserted into the corresponding openings with a snug fit, which applies especially to cleats having a cylindrical base part, corresponding tools can be provided in order to make it possible to exchange such cleats also.

The invention is suitable for athletic shoes with any type of cleat. In addition to balancing the height and decreasing the types of required cleats, the ability of the cleats to disengage from the ground by means of the flexible mounting of the cleats in the running sole, which protects covers and playing fields, is one of the important advantages making this invention different from the known arrangements.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. An athletic shoe having a running sole in which spike- or stud-shaped cleats are exchangeably mounted, said running sole having rows of openings and said cleats having base parts which are received in said rows of openings of the running sole, each row of cleats being fastened to the sole by means of a single holding means that is insertable and lockable on a side of the running sole, wherein the base parts of the cleats are fastened in the openings of the running sole in a manner so that they cannot be twisted about their longitudinal axis, and wherein base parts of the cleats have at least one borehole that is alignable with lateral boreholes in the running sole in each row of cleats for form a continuous borehole, a shaft being provided a a fastening means for each of said row of cleats, so that, by means of the insertion of a single said shaft into said continuous borehole, all of the cleats of a respective row of cleats is fastened jointly to said holding means, wherein said holding means is provided with a releasable locking means, and wherein the releasable locking means is a bayonet lock comprising the shaft, being provided, at one end, with a key-bit-shaped bend and, at its other end, being supported by a resilient element, and said borehole having a pocket-shaped enlargement, whereby said bend is engageable within the pocket-shaped enlargement of the borehole by means of an axial displacement of said shaft against the resilient element followed by a rotation of the shaft about its longitudinal axis.

2. An athletic shoe according to claim 1, wherein said shaft is tube-shaped.

3. An athletic shoe according to claim 1, wherein the resilient element is a head-shaped enlargement which is received in an enlargement at the continuous borehole.

4. An athletic shoe according to claim 3, wherein the base parts of the cleats, arranged near an edge of the running sole, are provided with at least two fastening points along their length, whereby said cleats are securable in more than one position relative to said openings.

5. An athletic shoe according to claim 1, wherein said holding means are strip-shaped and extended transversely to the longitudinal axis of the sole, and wherein each row of said openings is formed in a respective holding means.

6. An athletic shoe according to claim 3, wherein the strip-shaped holding means have a height that is larger than the diameter of the lateral boreholes, and a center line through said boreholes being located approximately in the center plane of the strip-shaped holding means.

7. An athletic shoe according to claim 3, wherein the resilient element is a head-shaped enlargement which is received in an enlargement at the continuous borehole.

8. An athletic shoe having a running sole in which spike- or stud-shaped cleats are exchangeably mounted, said running sole having rows of openings and said cleats having base parts which are received in said rows of openings of the running sole, each row of cleats being fasened to the sole by means of a single holding means that is insertable and lockable on a side of the running sole, wherein the base parts of the cleats are fastened in the openings of the running sole in a manner so that they cannot be twisted about their longitudinal axis, and wherein base parts of the cleats have at least one borehole that is alignable with lateral boreholes in the running sole in each row of cleats for form a continuous borehole, a shaft being provided a a fastening means for each of said row of cleats, so that, by means of the insertion of a single said shaft into said continuous borehole, all of the cleats of a respective row of cleats is fastened jointly to said holding means, wherein the base parts of the cleats, arranged near an edge of the running sole, are provided with at least two fastening points along their length, whereby said cleats are securable in more than one position relative to said openings.

9. An athletic shoe according to claim 8, wherein securing elements comprising pressure elements, operable for pressing a respective base part against a wall of an opening in the sole within which the base part is inserted, are provided.

10. An athletic shoe according to claim 9, wherein the pressure elements, at the same time, serve as a bearing for a respective shaft.

11. An athletic shoe according to claim 8, wherein securing elements comprising spreading elements, secured to a respective base part and operable for securing the base part within an opening in the sole by means of a spreading claw, are provided.

12. An athletic shoe according to claim 8, wherein the shaft, at one end, is provided with a head-shaped enlargement which is received in an enlargement at the continuous borehole, while its other end is equipped for the mounting of a releasable locking means.

13. An athletic shoe according to claim 12, wherein securing elements comprising pressure elements, operable for pressing a respective base part against a wall of an opening in the sole within which the base part is inserted, are provided.

14. An athletic shoe according to claim 13, wherein the pressure elements, at the same time, serve as a bearing for a respective shaft.

15. An athletic shoe having a running sole in which spike- or stud-shaped cleats are exchangeably mounted, said running sole having rows of openings and said cleats having base parts which are received in said rows of openings of the running sole, each row of cleats being fastened to the sole by means of a single holding means that is insertable and lockable on a side of the running sole, wherein the base parts of the cleats are fastened in the openings of the running sole in a manner so that they cannot be twisted about their longitudinal axis, and wherein base parts of the cleats have at least one borehole that is alignable with lateral boreholes in the running sole in each row of cleats for form a continuous borehold, a shaft being provided a a fastening means for each of said row of cleats, so that, by means of the insertion of a single said shaft into said continuous borehole, all of the cleats of a respective row of cleats is fastened jointly to said holding means, wherein said holding means have the shape of half shells provided with at least one wedge-shaped recess, a supporting part and a joint being provided on opposite sides of said recess for receiving a respective base part of a cleat, whereby the cleat having the base part received in the wedge-shaped opening can be swivelled in a direction of a longitudinal axis of the sole.

16. An athletic shoe according to claim 15, wherein, for enabling readjustment of the cleat to a normal position perpendicular to a running surface of the sole, the wedge-shaped recess is filled with an elastically-compressible material.

17. An athletic shoe according to claim 16, wherein a foamed plastic material is provided as the elastically-compressible material.

* * * * *